US012723525B2

(12) United States Patent
Bommarito et al.

(10) Patent No.: US 12,723,525 B2
(45) Date of Patent: Sep. 1, 2026

(54) THERMAL ENERGY STORAGE SYSTEM AND METHOD WITH HEAT RECOVERY STEAM GENERATOR

(71) Applicant: Nooter/Eriksen, Inc., Fenton, MO (US)

(72) Inventors: Gregory Bommarito, Ballwin, MO (US); Glen L. Bostick, Columbia, IL (US); Piero Scapini, Milan (IT); David Louis Wait, Port Ludlow, WA (US); Shaun P. Hennessey, St. Charles, MO (US)

(73) Assignee: Nooter/Eriksen, Inc., Fenton, MO (US)

( * ) Notice: Subject to any disclaimer, the term of this patent is extended or adjusted under 35 U.S.C. 154(b) by 0 days.

(21) Appl. No.: 18/842,003

(22) PCT Filed: Mar. 3, 2023

(86) PCT No.: PCT/US2023/014487

§ 371 (c)(1),
(2) Date: Aug. 27, 2024

(87) PCT Pub. No.: WO2023/168067

PCT Pub. Date: Sep. 7, 2023

(65) Prior Publication Data

US 2025/0179943 A1 Jun. 5, 2025

Related U.S. Application Data

(60) Provisional application No. 63/316,169, filed on Mar. 3, 2022.

(51) Int. Cl.

| | |
|---|---|
| ***F01K 3/12*** | (2006.01) |
| ***F01K 23/10*** | (2006.01) |
| *F28D 20/00* | (2006.01) |

(52) U.S. Cl.
CPC ..... *F01K 3/12* (2013.01); *F01K 23/10* (2013.01); *F28D 2020/0047* (2013.01)

(58) Field of Classification Search
CPC ... F01K 23/10; F01K 3/12; F01K 3/14; F01K 3/26; F28D 2020/0047; Y02E 60/14
See application file for complete search history.

(56) References Cited

U.S. PATENT DOCUMENTS 4,479,353 A * 10/1984 Schluderberg ..... F28D 20/0056 165/145
9,322,295 B2 * 4/2016 Pang ..... F28D 20/00
(Continued)

*Primary Examiner* — Jesse S Bogue
(74) *Attorney, Agent, or Firm* — Sandberg Phoenix & von Gontard, P.C.

(57) ABSTRACT

A system and method of retrofitting and operation, for a steam/media heat exchanger communicated with a heat recovery steam generator (HRSG) and with a flow of heat storage media. The steam/media heat exchanger receives heat from the HRSG steam and transfers said heat to the storage media. A first tank in fluid communication with the steam/media heat exchanger receives and stores the heated storage media. A second tank is flow connected to supply media to heat exchangers. The HRSG can include superheaters, desuperheaters, reheaters, and reheater desuperheaters which can be retrofitted with the steam/media exchangers to reduce or eliminate desuperheaters. A water/media exchanger exchanges heat with media flowing between the tanks, and heaters can add heat to media flowing into the first tank.

30 Claims, 7 Drawing Sheets

(56) References Cited

U.S. PATENT DOCUMENTS

| | | | | |
|---|---|---|---|---|
| 9,376,962 | B2 * | 6/2016 | Pang | F02C 7/224 |
| 10,767,556 | B2 * | 9/2020 | Bulat | F01K 23/10 |
| 10,982,570 | B2 * | 4/2021 | Conlon | F01K 11/02 |
| 12,264,599 | B2 * | 4/2025 | Bandhauer | F01K 15/00 |
| 12,480,719 | B2 * | 11/2025 | O'Donnell | F01K 13/02 |
| 2014/0223906 | A1 * | 8/2014 | Gee | F03G 6/071 60/641.15 |
| 2018/0179915 | A1 * | 6/2018 | Kirchner | F01K 23/10 |
| 2024/0418106 | A1 * | 12/2024 | Bostick | F01K 23/101 |
| 2025/0237166 | A1 * | 7/2025 | Pan | F02C 1/05 |

* cited by examiner

THERMAL ENERGY STORAGE SYSTEM AND METHOD WITH HEAT RECOVERY STEAM GENERATOR

CROSS-REFERENCE TO RELATED APPLICATIONS

This application hereby incorporates by reference, in its entirety, and claims the benefit of the filing date of the U.S. provisional patent application Ser. No. 63/316,169, which was filed on Mar. 3, 2022.

STATEMENT REGARDING FEDERALLY SPONSORED RESEARCH OR DEVELOPMENT

Not Applicable.

BACKGROUND OF THE DISCLOSURE

Many existing power plants, for electricity generation, were built with the intention of base load operation (e.g., having a fixed electrical output), and with the increasing impact from renewable energy sources are often operated at off design conditions during the day, at least, when large amounts of renewable energy are available. In other words, many existing power plants were designed and built to operate at a base load operation without significant deviation in order to maximize efficiency through operation within designed-for operating parameters (e.g., amount of gas turbine firing, input air rate, etc.). With increasing energy generation from renewable sources, subsequent power demand from fossil fuel fired facilities is lowered thus necessitating that these fossil fuel based power plants operate in modes of reduced power generation which subsequently results in a decrease in thermal efficiency. However, non-renewable energy power plants are still required in order to meet energy demand when renewable energy sources are not operating at peak output (e.g., during periods of time with reduced wind, at night, etc.). Therefore, a solution is needed in order to increase the efficiency of non-renewable power plants as these plants are still required at times of decreased renewable energy production.

Many existing power plants also suffer from additional problems when operated in at off design conditions. For example, in periods of low power demand, it is desirable to operate a Fossil Fuel Fired (FFF) combined cycle power plant (having, for example, both a gas fired turbine and a steam driven turbine using heat from the gas fired turbine) in very low load conditions so to save on fuel costs (power demand being met, for example, by renewable power generation). However, there is typically a minimum steam production required for the steam turbine which dictates that the associated gas turbine operate at higher loads than would otherwise be desired in the reduced load mode. What is needed therefore is a system that allows for the gas turbine to turn down to a lower load, thus saving fuel and reducing absolute emissions, while maintaining steam production at a level that meets the steam turbine demands.

Reduced load operation, resulting from increased renewable energy generation, negatively affects efficiency and performance, through resulting reduced load operation, of a variety of power plant types including but not limited, gas turbine power plants, combined cycle gas and steam power plants, coal fired power plants, or other power plants with decreased performance when not operating at base load. The impact of renewable energy sources from the resulting, at least part time, inefficient reduced load operation particularly affects combined cycle gas power plants.

A combined cycle power plant is basically comprised of a fuel combustion power plant that is combined with a steam power plant. For example, a combustion turbine powering a first electric generator that is combined with a steam turbine powering a second electric generator. Such combined cycle gas power plants typically utilize a heat recovery steam generator (HRSG) system. Such HRSG systems use the high temperature of the exhaust gas produced by the combustion turbine by directing it through a heat recovery boiler or heat recovery steam generator to generate steam from the heat of the exhaust gas. The steam generated is communicated to a steam turbine and drives the steam turbine.

Combined cycle power plants using an HRSG are particularly affected by reduced load operation because during off design operating conditions of a combined cycle power plant, it is common that the temperature of the steam at the HRSG outlet that extends from the HRSG superheater is much higher than the temperature of the steam that the HRSG steam turbine or other systems can accommodate unless some means of attemperating or reducing the temperature of the steam is employed. The increased steam temperature results from how the gas turbine achieves part load operation. To maintain as high of efficiency as possible, it is desirable for the gas turbine to fire in the combustion chamber to a maximum temperature. This temperature is typically limited by a metal temperature in the first stage turbine blades immediate downstream of the combustors. During part load operation, the fuel flow is reduced so to introduce less available energy to the system. The reduction in fuel flow alone can cause issues within the combustor such as flame stability problems which result from a disconnect between fuel flow velocities and oxidizer (i.e., air) velocities in the burner nozzle areas. This imbalance can lead to unsteady combustion which can lead to pressure pulsations, noise generation and in extreme cases flame blowoff. Emissions from the turbine, which are regulated, are also impacted as the cooler flame (i.e., due to high excess air) can result in elevated carbon dioxide emissions while at the same time the unstable flame may have regions of elevated temperature which can also increase nitrous oxide formation. To avoid the noted issues, as the turbine reduces load and decreases fuel flow, there is a simultaneous reduction in air flow through the machine as the inlet guide vanes at the compressor inlet are throttled. The reduction in air flow results in higher exhaust temperature as the reduced airflow provides for reduced cooling. As turbine load continues to decrease, select burners are taken out of service so to maintain acceptable emissions and flame stability. At some point in the load reduction, the turbine inlet guide vanes are throttled to their minimum opening and subsequent reductions in turbine load see a substantial reduction in gas turbine exhaust temperature as the fuel flow decrease is the only remaining means to reduce power generation. For at least these reasons a system is needed to allow a power plant to operate at design conditions even when there is reduced power demand (from supply by renewable energy sources) to reduce or eliminate such control measures and resulting adverse impacts. It is also possible that the increased temperature of the steam from part load operation could exceed some of the boiler metal design temperature limits during extreme cases of off design operation of a combined cycle power plant unless some active means are employed to control the temperature of the steam.

In existing combined cycle power plants and plants with HRSG systems, steam temperature leaving the HRSG and prior to entering a turbine, boiler, tank, or the like can be controlled using a direct contact desuperheater (DSHTR) to reduce steam temperature to within design parameters.

A common approach for high pressure HRSG systems is the use of a direct contact desuperheater in the system. The direct contact desuperheater introduces a cooling water flow into the HRSG that is used to reduce the steam temperature to a required set point of operation. However, the introduction of the cooling water by the direct contact desuperheater reduces the efficiency of the HRSG system due to the fact that the cooling water introduced into the HRSG is not passed through all of the same heating surfaces of the HRSG and therefore is not pulling as much heat energy out of the exhaust gas of the combustion turbine when compared to a HRSG that does not employ a desuperheater. In other words, efficiency is reduced because although the cooling water is evaporated into steam and discharges from the HRSG, the increased level of sub-cooling for this steam production is much greater than if the same amount of water would have been able to pass through the preheating surfaces upstream of the evaporator and subsequently have a lower level of subcooling. Desuperheaters can be used in this manner in both high pressure loops with superheaters and reheater loops using reheaters. Desuperheaters used in connection with reheat loops have the added negative that the introduction of reheater desuperheater spray flow directly reduces the generation of the high pressure, and more valuable, steam. In any event, cooling steam using a desuperheater negatively impacts efficiency.

Another approach used for steam temperature control in some HRSG systems is the use of a steam bypass. In a steam bypass, steam is communicated around heat exchangers of the HRSG system to produce cooler final steam in comparison to running steam through all heat exchangers of the HRSG system. The cooler bypass steam is reintroduced into the main steam flow communicated through the HRSG to control the final target steam temperature. This reduces efficiency because not all the heat that is capturable using the HRSG system is captured.

In existing power plants that utilize desuperheaters, such use can cause further undesirable effects. For example, in periods of lower power demand in FFF combined cycle facilities, the resulting gas turbine exhaust increases in temperature with a subsequent reduction in exhaust mass flow. The subsequent consequence to the heat recovery steam generator (HRSG) is an increase in steam temperature, which results from the higher exhaust gas temperature and the reduction in steam production resulting from the lower exhaust gas mass flow. As the steam temperature must be regulated, a significant increase in cooling water is often required for use by the desuperheater(s). The cooling water can be introduced directly into the steam and large quantities of cooling water can produce adverse/non-desirable effects on the HRSG such as potential water induction into hot heating surfaces which can be damaged by imposed thermal shock stresses or poor process control resulting from poor temperature measurements. What is needed is a system that provides for steam temperature control that mitigates such adverse effects.

Typical combined cycle power plants face additional problems that impact efficiency. For example, as ambient temperature rises above the design ambient condition for a combined cycle power plant there is a reduction in mass flow from the gas turbine, which is a constant volume machine. This reduced mass flow results in conditions that parallel those encountered in part load operation (i.e., higher exhaust gas temperature and reduced mass flow). What is needed therefore is a system that allows for additional steam to be generated in such conditions to address the "shortfall" in production resulting from the off design conditions thus allowing the steam turbine to make more power than it otherwise would have been able to achieve under the plant conditions.

What is needed are: 1) systems and methods for improving the efficiency of fossil fuel power plants, including combined cycle power plants, when operating in conditions that include periods of below base load operation, 2) systems and methods for converting part load inefficiencies into benefits for the plant during periods of high demand, 3) systems and methods for increasing the plant flexibility by allowing lower reduced loads to be achieved, and 4) systems and methods for maximizing power plant production during warmer ambient conditions when compared to design conditions.

Figure 1:
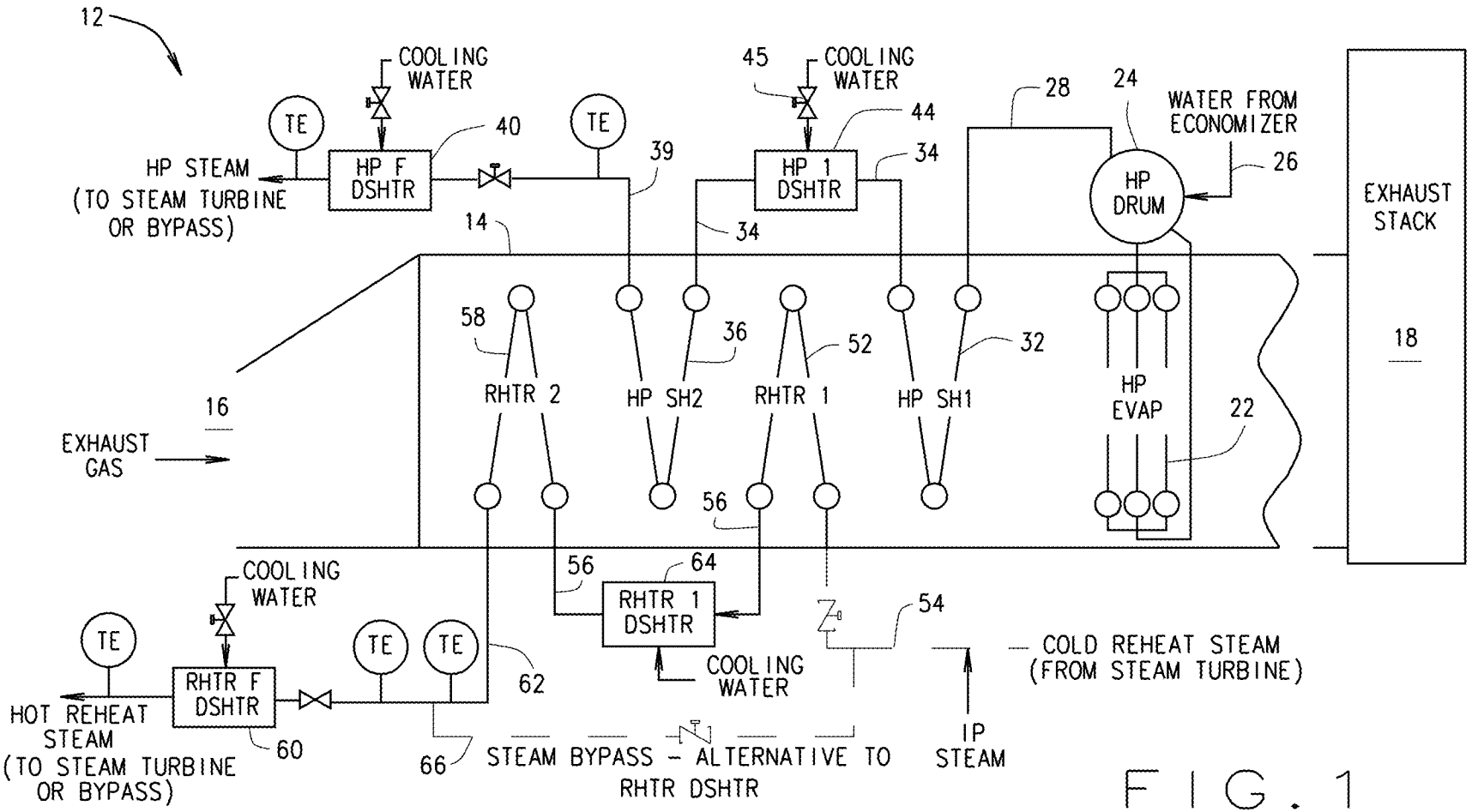
FIG. 1 is a diagrammatic representation of a heat recovery steam generation system in a combined cycle power plant with a desuperheater system for controlling the temperature of steam exiting the heat recovery steam generation system prior to entering a steam turbine system or component thereof.

Corresponding reference characters indicate corresponding parts throughout the several views of the drawings. Similarly numbered parts also have the same or similar characteristics unless otherwise specified. For example, the hot tank 194 is the same as the hot tank 294. Components shown in dashed lines are optional and can be present or omitted depending on different embodiments and different use cases. Components that are illustrated and not otherwise discussed, should be given their ordinary meaning based on the understanding of one skilled in the art (e.g., valves, temperature sensors, and the like depicted according to industry standard symbols). Components connected with lines are in fluid communication with each other and can be connected directly or with intervening components in other embodiments not depicted. The drawings use the encircled letters "TE" at various points to indicate the position of temperature sensors that sense fluid temperatures at various points.

DESCRIPTIONS OF DISCLOSURES

Referring generally to FIGS. 1-7, the systems and methods disclosed herein provide for increased efficiency and/or flexibility in power generation applications, including but not limited to, combined cycle power plants. The systems and methods disclosed herein are applicable to any system/method in which the temperature of steam must be controlled and can involve cooling steam to maintain input steam within design parameters (e.g., using a steam desuperheater). Generally, the disclosed systems and methods provide for maintaining input steam within design parameters by removing heat from steam above said parameters using a thermal medium and storing the thermal medium for later use in heating steam or other fluids for use in power generation and/or other processes. By using the thermal medium to cool the input steam and store the removed heat for later use, in addition to or in place of using a steam desuperheater, heat that would otherwise be wasted or recovered at a low efficiency is recovered and stored for later use. This improves the efficiency and/or flexibility of the power generation system or other system/method in which steam temperature is controlled.

More particularly, in some embodiments of the energy storage apparatus of this disclosure, hot steam which normally would be passed through a desuperheater and cooled off, is instead passed through a steam/thermal media heat exchanger. In the steam/thermal media heat exchanger the steam temperature is reduced while giving off heat to a thermal storage media, such as molten salts or any other suitable equivalent media that flows through the steam/thermal media heat exchanger. The cooled steam is returned to the HRSG to be output by the HRSG to, for example, a high pressure steam turbine or drum, while the heated thermal media is communicated to a hot storage tank for later use (e.g., when power generation at base or above base, peak, or other load). In the HRSG, the desuperheaters can be left in place and the flow of steam through the HRSG can be split between the desuperheater and the thermal energy storage system, for all of the flow of steam to pass through the thermal energy storage system or for all of the flow of steam to pass through the desuperheater in the event the thermal energy storage system is offline.

Referring now to FIG. 1, a heat recovery steam generation system 12 is shown according to one embodiment. Such a system can be modified or retrofit to include the thermal energy storage system 100 of the type described herein. Alternatively, a complete system including both the heat recovery steam generation system 12 and the thermal energy storage system 100 can be constructed as single installation rather than a retrofit of an existing system. It should be understood that the heat recovery steam generation system 12 (and the thermal energy storage system 100) described herein are exemplary only. The thermal energy storage system 100 and the variations disclosed herein, as well other consistent embodiments, can be used with a heat recovery steam generation system 12 or other equivalent system. For example, heat recovery steam generation system 12 is depicted as a system for use in a combined cycle gas power plant for recovery heat, for steam generation, from exhaust gas from a gas fired turbine. However, the thermal energy storage system 100 can be used with any other suitable heat recovery system or other system in which the temperature of recovered heat is controlled (e.g., used with a coal fired power plant, industrial process using steam, etc.).

Still referring to FIG. 1, in the depicted embodiment the heat recovery steam generation system 12 is part of a combined cycle power plant including a gas fired turbine. The HRSG 12 includes an exhaust duct or a housing 14 for receiving exhaust gas and passing the exhaust gas over heat recovery elements. The housing 14 has an exhaust gas opening 16 at one end of the housing 14, represented at the left end of the housing 14 in FIG. 1. The housing 14 also has an exhaust gas outlet or exhaust stack 18 at the opposite end of the housing 14, or at the right end of the housing represented in FIG. 1. The exhaust gas inlet or opening 16 is operatively communicated with a power plant burner or other power generation equipment such as a gas fired turbine (not shown) and receives hot exhaust gas emitted by such a source for heat recovery, e.g., in a combined cycle power plant. The hot exhaust gas is channeled through the housing 14 from left to right as represented in FIG. 1 from the exhaust gas inlet or opening 16 to the exhaust gas outlet or stack 18. The passing of exhaust gas through the housing 14 is used to remove heat from the exhaust gas and use the recovered heat for steam generation. The generated steam can be used, for example, in a combined cycle power plant for power generation using a steam turbine (i.e., to supplement power generation from a gas fired turbine). Generally, heat is extracted from the exhaust gas using one or more heat exchangers with heat transferred to a working fluid (e.g., water) for steam generation.

In the depicted embodiment, the HRSG 12 includes a plurality of heat exchangers for this purpose. The heat exchangers can be of any suitable type including supported tube fields in the gas stream, one or more of shell and tube heat exchangers, double pipe heat exchangers, plate heat exchangers, or any other suitable heat exchanger known to one of ordinary skill in the art. In the depicted embodiment, a high pressure evaporator heat exchanger 22 is positioned and supported in the housing 14. It should be noted that other equipment can be positioned between the high pressure evaporator heat exchanger 22 and the exhaust stack 18, such as and for example, high pressure economizer(s); intermediate pressure operating systems and/or low pressure operating systems each with their own superheaters, evaporators, economizers, etc.; preheaters; and/or other equipment. An example of a heat recovery steam generator system and such equipment is the heat recovery steam generator system described in U.S. Pat. No. 6,508,206, the entirety of which is hereby incorporated by reference, and the heat recovery steam generator system described in U.S. Pat. No. 10,180,086, the entirety of which is hereby incorporated by reference. The high pressure evaporator heat exchanger 22 is in fluid communication with a high pressure steam drum 24. As used herein, the term "fluid communication" should be understood to mean, unless expressly described otherwise, that two components in fluid communication are capable of receiving a fluid between them in unidirectional or bidirectional fashion either directly or through intermediate components, with fluid passing through, for example, a conduit, tube, pipe, duct, or the like. The high pressure evaporator heat exchanger 22 is connected by piping, tubes, ducting, or the like to be in fluid communication with the high-pressure drum 24, in some embodiments directly. The high pressure drum 24 is adapted and configured to store high pressure steam to feed other components of the HRSG system 12 and/or for use in driving a steam turbine, directly or indirectly.

In the depicted embodiment, the high pressure steam drum 24 is fed by water from an economizer (not shown) in fluid communication with the high pressure steam drum 24. The economizer is adapted and configured to pre-heat feed water into the HRSG (e.g., as a feedwater heater). In other words, the high pressure steam drum 24 is fed by water from an economizer in fluid connection with a feed water source, the received water then being heated using the high pressure evaporator heat exchanger 22 and then stored in the high pressure steam drum 24 as steam for feeding into additional components of the heat recovery steam generation system 12. It should be understood that the high pressure steam drum 24 is connected in fluid communication with any input source of water 26. For example, the input source of water 26 could be new water or could be condensed steam that is returning from a steam turbine for re-use.

In some embodiments, water in the high pressure steam drum 24 is communicated to the high pressure evaporator 22 that heats the water to its boiling point producing steam. The steam/water mixture pass through the high pressure evaporator 22 and are fed to the high pressure drum 24 where the water and steam are separated. The water in the high pressure drum 24 is cycled back to the high pressure evaporator 22 while the steam collected in the high-pressure drum 24 is directed to a first high pressure superheater 32 in fluid communication with the high pressure steam drum 24. The first high pressure superheater 32 is a heat exchanger adapted and configured to remove heat from exhaust gasses within the housing 14 and transfer heat to the steam from the high pressure steam drum 24. High pressure steam can be provided from the high pressure steam drum 24 to the first high pressure superheater 32 through piping 28. In some embodiments, the high pressure steam drum 24 feeds the first high pressure superheater 32 directly. In alternative embodiments, there can be one or more intermediate components (e.g., and as the term is used throughout, control devices such as valves, bypasses, additional heat transfer components such as heat exchangers, take offs, and or other components).

The first high pressure superheater 32 feeds, indirectly and through piping 34, a second high pressure superheater 36. The second high pressure superheater 36 feeds, indirectly and through piping 38, a high pressure portion of a steam turbine (e.g., of the combined cycle power plant) (not shown). Positioned between first high pressure superheater 32 and the second high pressure superheater 36 is a first high pressure desuperheater 44. Positioned downstream of the second high pressure super heater 36 is a second high pressure desuperheater 40. In alternative embodiments, the second high pressure desuperheater 40 is omitted.

The first high pressure superheater 32 raises the temperature of the steam to a superheated state. As previously explained, when the combine cycle power plant is operating in a reduced load operating state, the temperature of the exhaust within the housing 14 can be hotter than when operating at base load operation. As a result, the amount of heat transferred to the steam by the first high pressure superheater 32 can cause the temperature of the steam to exceed design parameters. The same is true for the second high pressure superheater 36 discussed in greater detail later herein and/or any other superheater sections (e.g., any number of additional high pressure superheaters can be used, and in the case of two or more such superheaters, a corresponding desuperheater is typically, though not required to be, located between the superheater closest to the evaporator and the next superheater located in series with the first). The increased exhaust gas temperature in a reduced load operating state can result, for example, from operation of a gas turbine engine with less air throughput which in turn does not cool the exhaust gas to the degree when the turbine is operated with higher air throughput in base load operation, as previously explained. In order to reduce the temperature of the steam to within design parameters, the steam exiting the first high pressure superheater 32 is passed through a first high pressure desuperheater 44. The first high pressure desuperheater 44 is selectively controlled to reduce the temperature of the steam passing through it using cooling water. For example, the flow of cooling water to the first high pressure desuperheater 44 is controlled using a valve 45 upstream of the first high pressure desuperheater 44 and in fluid communication with both a source of the cooling water and the first high pressure desuperheater 44. The valve is opened to provide additional cooling water when the temperature of the steam is to be reduced and is closed partially or completely to raise the temperature of the steam (e.g., by reducing cooling by the first high pressure desuperheater 44). The first high pressure desuperheater 44 can be any suitable desuperheater such as, for example, a multi-nozzle spray desuperheater, a tube bundle type desuperheater, a water bath type desuperheater, a water spray desuperheater, a single point radial injection spray desuperheater, a multiple point radial injection spray desuperheater, an axial injection spray desuperheater, a reverse flow type axial desuperheater, a multiple nozzle axial injection desuperheater, a variable area type multiple nozzle desuperheater, or any other suitable direct contact or indirect contact desuperheater. In other embodiments, the first high pressure desuperheater 44 is otherwise controlled based on the temperature of the steam. In some embodiments, the first high pressure desuperheater 44 is controlled based on a temperature sensor positioned downstream of the second high pressure superheater 36 and upstream of the second high pressure desuperheater 40. The steam temperature immediately downstream of the DSHTR can also be used in the control of the cooling water flow.

Steam leaving the first high pressure desuperheater 44 enters, directly or indirectly, the second high pressure superheater 36, with the first high pressure desuperheater 44 being in fluid communication with the second high pressure superheater 36. For example, the first high pressure desuperheater 44 is coupled to the second high pressure superheater 36 by piping 34. The second high pressure superheater 36 is a superheater similar to or of the same construction as the first high pressure superheater 32. The second high pressure superheater 36 is a heat exchanger. The second high pressure superheater 36 is adapted and configured to remove heat from exhaust gas 16 passing through the housing 14 and transferring heat to the steam and increase the temperature of the steam (e.g., to a superheated state).

Steam leaving the second high pressure superheater 36 is passed, directly or indirectly, to the second high pressure desuperheater 40, with the second high pressure superheater 36 being in fluid communication with the second high pressure desuperheater 40. For example, the second high pressure superheater 36 is coupled to the second high pressure desuperheater 40 by piping 39. The second high pressure desuperheater 40 is typically of the same or similar construction as the first high pressure desuperheater 44. In alternative embodiments, the construction of the second high pressure desuperheater 40 differs in construction and/or operation from the first high pressure desuperheater 44. The second high pressure desuperheater 40 is fed by cooling water from an appropriate source and is controlled to maintain the temperature of steam exiting the second high pressure desuperheater 40 within design parameters. For example, the flow of cooling water to the second desuperheater 40 can be controlled to cool the steam based on a temperature sensor positioned downstream of the second high pressure desuperheater 40. One or more control valves controlling inflow of the steam in FIG. 1 can also be used to control the second high pressure desuperheater 40.

Steam exiting the second high pressure desuperheater 40 is fed, directly or indirectly, to a high pressure portion of a steam turbine for power generation. Alternatively, additionally, or partially, some or all steam can be directed to a bypass that bypasses the steam turbine. Such bypass can be controlled by any suitable technique and/or hardware known to one of skill in the art. Steam may also be directed to a process and/or to both a steam turbine and process in parallel.

In some embodiments, the HRSG 12 also includes a first reheater 52 positioned within the housing 14. The first reheater 52 is a heat exchanger, of any suitable type as previously described herein, adapted and configured to transfer heat from the exhaust gas 16 passing through the housing 14 to steam supplied to the first reheater 52. The first reheater 52 can be any suitable reheater. In some embodiments, the first reheater 52 is in fluid communication, directly or indirectly, with a source of intermediate pressure steam and/or cold reheat steam. For example, the cold reheat steam can be steam exiting the high pressure portion of a steam turbine, and the intermediate steam can be steam exiting an intermediate pressure portion of the HRSG. For example, cooled steam that has passed through the high pressure portion of the steam turbine (not shown) is communicated by piping 54 from the steam turbine to the first reheater 52 in the boiler housing 14. Similarly, intermediate pressure steam from the intermediate pressure system of the HRSG can be fed to the first reheater 52 by piping 54. The first reheater 52 raises the temperature of the intermediate pressure steam or a mixture of the intermediate pressure steam and the cold reheat steam received from the steam turbine. Steam exiting the first reheater 52 is then communicated by, for example piping 56, directly or indirectly to a first reheater desuperheater 64 and then, directly or indirectly to a second reheater 58. Steam exiting the second reheater 58 can be fed, directly or indirectly, through a conduit (e.g., piping 65 to a second reheater desuperheater 60). Steam leaving the second reheater desuperheater 60 is fed as hot reheat steam to the steam turbine (not shown) (e.g., an intermediate pressure portion of the steam turbine). In some embodiments, the steam exiting the second reheater 58 is fed to a different portion of the steam turbine.

The first reheater desuperheater 64 is positioned downstream of the first reheater 52 and is in fluid communication with the first reheater 52 (e.g., by the additional pipes or tubes 56 that communicate the first reheater 52 with the second reheater 58). In some embodiments, the first reheat desuperheater 64 immediately follows the first reheater 52. In alternative embodiments, additional components can be located between the first reheater 52 and the first reheater desuperheater 64. In still further embodiments, the first reheat desuperheater can be located upstream of the first reheater. The first reheat desuperheater 64 is any suitable type of desuperheater (e.g., one of the types described previously with respect to the first high pressure desuperheater 44). When operated, the first reheat desuperheater 64 cools the steam such that the steam temperature in the pipes or tubes 56 is reduced to a desired temperature. The first reheater desuperheater 64 can be controlled using one or more temperature sensors (TE) positioned downstream of the first reheater desuperheater 64 (e.g., positioned downstream of the second reheater 58). The first reheat desuperheater 64 is of any suitable desuperheater type (e.g., of the type previously described with respect to the high pressure desuperheater 44). The second reheat desuperheater 60 is positioned downstream of the second reheater 58 and is in fluid communication with the second reheater 58 (e.g., by the additional pipes or tubes 62). In some embodiments, the second reheat desuperheater 60 is positioned immediately following the second reheater 58. In alternative embodiments, additional components can be located between the second reheater 58 and the second reheater desuperheater 60 (e.g., temperature sensors, control valves, bypasses, etc.). The second reheater desuperheater 60 can be controlled using one or more temperature sensors, control valves, or other equipment (e.g., a temperature sensor upstream and/or downstream of the second reheater desuperheater 60). The second reheater desuperheater 60 is controlled to maintain the temperature of the steam exiting to within design parameters of the HRSG 12. Steam exiting the second reheater desuperheater 60 is provided to the steam turbine (not shown).

In some embodiments, the HRSG 12 includes a steam bypass 66 shown in dashed lines in FIG. 1. In alternative embodiments, the steam bypass 66 is omitted. The steam bypass 66 is controllable (e.g., using one or more valves and/or temperature sensors TE) to allow for steam to bypass the first reheater 52 and second reheater 58 so to control the final steam temperature leaving the HRSG. The steam bypass 66 when set to bypass, causes a portion or all of the cold reheat steam and or intermediate pressure steam to bypass the first reheater 52, the first reheater desuperheater 64, and the second reheater 58, with the steam exiting the bypass 66 upstream of the second reheater desuperheater 60.

As previously explained, the use of desuperheaters 40, 44, 60, 64 (or any subset thereof in alternative embodiments with differing numbers of desuperheaters) and/or the use of a steam bypass 66 reduces the efficiency of the HRSG as steam is either cooled, wasting heat, or not heated in the first place in the case of the steam bypass 66, again wasting heat. The reduced efficiency of heat recovery during reduced load operations harms the overall efficiency of the HRSG 12. Furthermore, the ability of desuperheaters to sufficiently cool steam as a control mechanism is limited because the amount of desuperheater water which can be introduced (e.g., in the case of direct contact desuperheaters) is limited by the saturation temperature of the steam at the point of water injection (water cannot be sprayed below saturation), the relative amount of spray water to the steam flow, and the piping configuration. While the piping configuration can usually be addressed for new plants, existing plants that have been forced to operate in off-design operations are limited.

Another approach used for steam temperature control is that of a steam bypass. This system is more typically employed on lower pressure systems where margins between the design pressure of the tube/piping and the code defined allowable stress are more easily addressed/supplied. In a steam bypass, steam is passed around heating surface (some or all) with the cooler bypass steam being reintroduced into the main steam so to control the final target steam temperature. For these reasons, desuperheaters and/or steam bypasses present significant drawbacks in efficiency and temperature control.

Referring now to FIGS. 2-7 generally, a thermal energy storage system 100 is depicted according to several embodiments which improves the efficiency and/or control of a HRSG 12. The disclosed embodiments of the thermal energy storage system 100 allows for thermal energy storage (TES) in a combined cycle plant by replacing or augmenting the normal steam temperature controller (a desuperheater) with a heat exchanger system that removes the excess heat from the steam during off design/reduced load periods of operation and returns the energy (via steam generation) during periods of high steam/power demand.

The thermal energy storage system 100 is a heat storage system in which the hot steam, which would normally be passed through a desuperheater and cooled off, is instead passed through a heat exchanger where the steam temperature is reduced while giving off heat to a thermal storage media such as, preferably molten salts, or any other suitable media (e.g., water, thermal oil, etc.). Salt is an exemplary thermal storage media, but other media can be used in alternative embodiments. The cooled steam is returned in a location just downstream of the desuperheater while the heated thermal media is returned to a hot storage tank. The desuperheater is left in place and allows for the flow of the steam to be split between the desuperheater and the thermal energy storage (TES) heat exchanger, for all the flow to pass through the TES, or for all the flow to pass the desuperheater in the event the TES is offline or there is no excess steam temperature at the terminal point.

During high steam/power demands for the power plant or when increased plant flexibility is desired, the hot storage media is pumped through a water/salt heat exchanger so to produce saturated or superheated steam which is then introduced into any one of the operating steam systems, with the high pressure drum outlet piping being the preferred point of introduction. The salt leaving the water/salt exchanger is delivered into a cold storage tank which serves as a reservoir feeding the steam/salt exchanger(s).

The thermal energy storage system 100 system can also be used to provide heat to any other industrial heat user such as, for example, district heating or power plant conditioning.

It should be understood that the examples disclosed herein are examples only and that the thermal energy storage system 100 can be used in additional or alternative examples (e.g., 200-600). For example, the thermal storage media can be any substance that satisfies process needs. Molten salt is an example and while it is the preferred media due to lower cost, availability, and safety, any suitable media can be used. The disclosed embodiments are for use with at least an "intermediate" desuperheater or possibly a bypass or both. However, there are many plants that also employ a final stage desuperheater where the desuperheater is located on the terminal steam piping. This is a less likely application area than the intermediate location, but thermal energy storage system 100 can be positioned to operate with such desuperheaters. In other words, the general use of a steam/storage media heat exchanger to replace or supplement a desuperheater allows for the thermal energy storage system 100 to be used on any number or configurations of power plants or other systems using desuperheaters. For example, for HRSGs/boilers with multiple pressure levels (i.e. high pressure, reheater-intermediate pressure, low pressure, etc.), a desuperheater is generally employed only on the high pressure and reheater sections. But multiple desuperheaters could be used. For a boiler/heat recover steam generator with only one pressure system, the one pressure system by default is potentially subject to the need of a desuperheater. The thermal energy storage system 100 described herein is not restricted or limited based on the number of pressure levels in a single boiler/HRSG or the arbitrary designation of high pressure, intermediate pressure, or low pressure. Any suitable number of desuperheaters can be used in combination with any suitable number of steam/thermal storage media heat exchangers to effectuate the function of the thermal energy storage system described herein with reference to the depicted embodiments or other embodiments.

The thermal energy storage system 100 provides the benefits to combined cycle power plants (and other operations) described herein throughout, including increased efficiency by storing excess heat generated in part load power plant operation, high power production during peak demand periods by utilizing stored heat, increased plant flexibility by allowing lower reduced loads to be achieved, higher steam production in off design ambient conditions and reduced concerns with high levels of water injection (e.g., erosion/stress induced failures, corrosion) by reducing the need for desuperheater operation. Elimination or reduction of desuperheater use also is a desirable feature in that potential damage or wear to the HRSG and/or steam turbine are reduced when less water is introduced into the steam (e.g., in the case of direct contact/spray desuperheaters). The damage from desuperheater use can come in a variety of forms including thermal fatigue, erosion, and/or chemical imbalance in steam chemistry.

Put more succinctly, power plants are being forced into more and more off design operating modes so to accommodate the influx of power from renewable energy sources. These off design modes result in inefficient plant operation, reduced plant life, and may create safety concerns. The thermal energy storage system 100 described herein provides advantages by allowing power plants to operate more efficiently and with greater flexibility by storing energy generated at off design conditions, which is unusable/undesirable, and returning the energy to the system, or a separate user, at a time when the energy is more useful (e.g., base load operation).

While helping to improve efficiency at part load is desirable and is achieved using the systems and methods described herein, such systems and methods also provide further benefits by addressing the inefficiencies that materialize during part load operation in a manner that allows one to turn these inefficiencies into a means to improve plant operation during periods when power demand increases thus calling for the fossil fuel fired (FFF) plant to operate back up at base load. The systems and methods described herein allow the operating unit to now be operated at a performance level that exceeds the original base load operations by drawing energy from the energy stored during off-peak demand/part load operation. This improved performance may take many forms such as but not limited to; an increase in steam production and thus more power production for power cycles, an increase in process steam thus allowing other steam generators to not need to operate or drawing from a thermal energy storage system to achieve the normal base load steam production rates while burning less fuel in the heat source thus reducing fuel costs for the plant and potentially improving the heat rate for the plant. Further benefits provided by the systems and methods described herein include allowing for the gas turbine to turn down to a lower load, thus saving fuel and reducing absolute emissions, while drawing energy from the thermal energy storage system to maintain steam production at a level that meets the steam turbine demands (e.g., supplies the steam turbine with a minimum required amount of steam while allowing the gas turbine to be run at reduced load, saving fuel and emissions, where such load would not produce enough heat on its own to supply the minimal requirements of steam to the steam turbine). The systems and methods described herein also reduce or eliminate some adverse effects resulting from the use of superheater(s) by replacing such components with a thermal energy storage system for controlling the temperature of steam existing the heat recovery steam generator. For example, reducing or eliminating the use of cooling water injected by desuperheater(s) reduces or eliminates the thermal shock and corresponding wear and tear that results from using injected cooling water. Another benefit of the systems and methods described herein is that such system and methods address inefficiencies resulting from off design operating conditions (e.g., operation in ambient temperature conditions above design). For example, the systems and methods described herein allow for stored energy (in the thermal energy storage system) to be used to make steam and address the "shortfall" in production resulting from off design conditions (e.g., when the plant is operating in ambient temperatures above the designed for ambient temperatures) thus allowing the steam turbine to make more power than it otherwise would have been able to achieve under the plant conditions.

Figure 2:
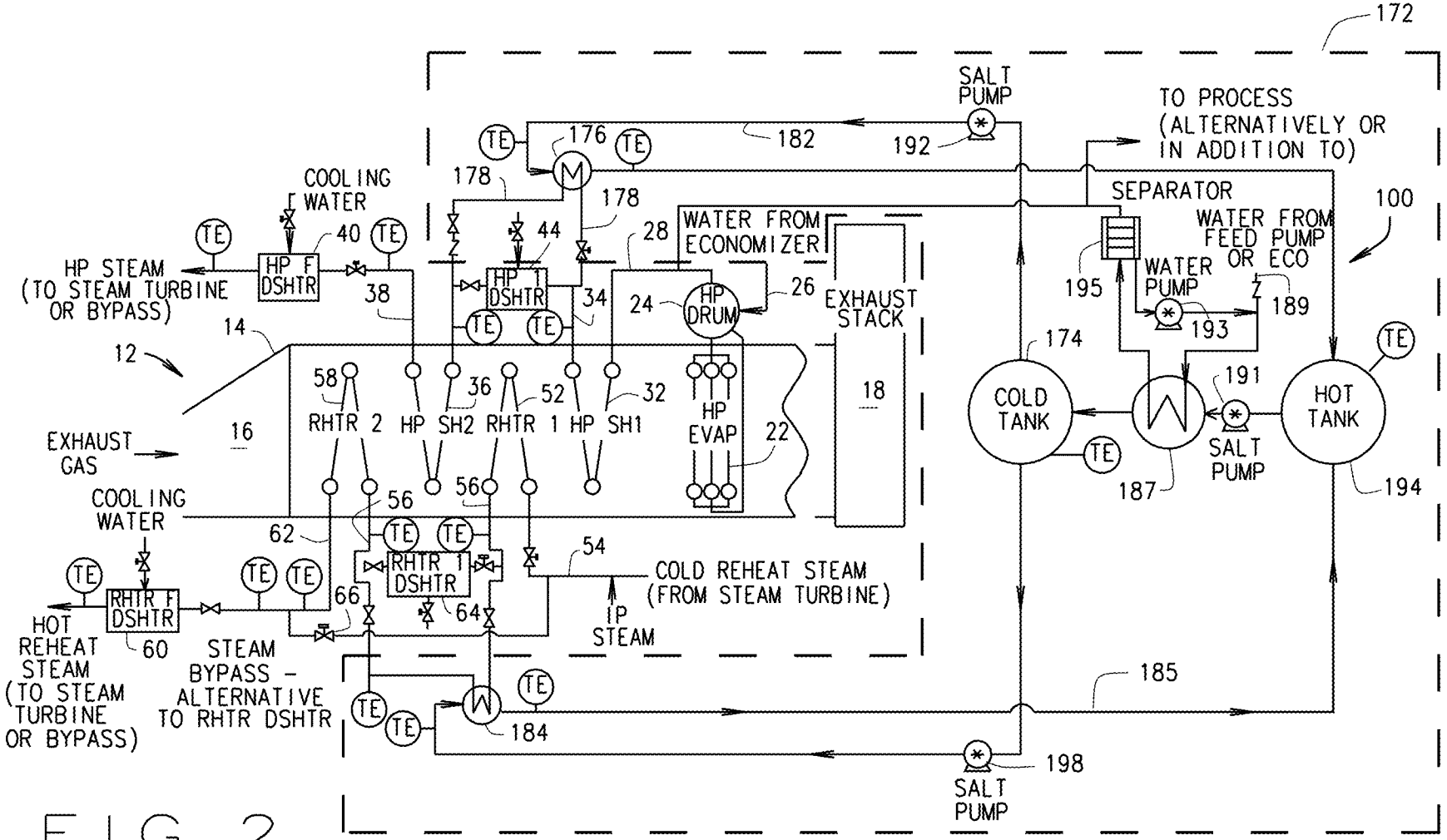
FIG. 2 is a diagrammatic representation of a thermal energy storage system that recovers and stores heat from an HRSG system of the type shown in FIG. 1, reducing or eliminating the need for use of a desuperheater and thereby improving power plant efficiency.

Referring now specifically to FIG. 2, the general principles and components of the thermal energy storage system 100 described above are discussed in greater detail. The thermal energy storage system 100 of this disclosure is represented inside the dashed line boundary 172 of FIG. 2. The thermal energy storage system 100 is combined with the HRSG 12 and replaces or augments the steam temperature control provided by the desuperheaters 40, 44, 60, 64. This combination can be performed as either a retrofit or as a ground up design/build. It should be understood that a person of skill in the art can use the disclosure herein in a method of retrofitting an existing HRSG 12 with the thermal energy storage system 100 by coupling the components of the energy storage system 100 to an existing heat recover steam generator 12 at the locations described herein. Further, any necessary temperature sensors, valves, control systems, and the like can be added to effectuate the functions described herein as would be understood by a person of skill in the art.

One or more of the desuperheaters 40, 44, 60, 64 are replaced or supplemented with a heat exchanger system 176, 184 (i.e., a steam/TES heat exchanger) that removes excess heat from the steam (e.g., to bring the temperature of the steam to within design parameters).

The thermal energy storage system 100 includes a cold tank 174 that stores a flowable heat storage media (e.g., thermal salt, molten salt, thermal oil etc.). Preferably the heat storage media is molten salt. The cold tank 174 is insulated sufficiently to keep the heat storage media stored in the cold tank in a flowable condition. In some embodiments, additional heaters, heating elements, steam, or other heat sources can be used to ensure that the heat storage media remains in a pumpable state. During periods when the TES is not required to be charging or discharging, a continuous flow of salts may be passed through the salt flow path and exchangers so to maintain the metal temperatures above the freezing point of the salt(s). This recirculation freeze protection may also be employed for other embodiments of the system described herein.

The thermal energy storage system 100 includes a first high pressure steam/thermal media heat exchanger 176 adapted and configured to remove heat from steam within the HRSG 12. The steam/thermal media heat exchanger and such device described herein can be any suitable heat exchanger (e.g., of the types previously described with respect to the first high pressure superheater 32) that is suitable for transferring heat from steam to a thermal media (e.g., molten salt). The first high pressure steam/thermal media heat exchanger 176 is in fluid communication with the cold tank 174, directly or indirectly, to receive thermal storage media (e.g., thermal media), from the cold tank 174. The first high pressure steam/thermal media heat exchanger 176 is positioned such that it can be fed steam from the first high pressure superheater 32, the first high pressure steam/thermal media heat exchanger 176 being in fluid communication, directly or indirectly, with the first high pressure superheater 32. For example, the first high pressure steam/thermal media heat exchanger 176 is connected by pipes or tubes 34 and 178 to selectively bypass the first high pressure desuperheater 44 connected between the first high pressure superheater 32 and the second higher pressure superheater 36. The temperature of the steam entering the second high pressure superheater 36 can be controlled by selectively bypassing the first high pressure desuperheater 44, entirely or partially, using the depicted control valves and based on data from one or more temperature sensors (e.g., temperature sensors upstream of the first high pressure desuperheater 44 and/or downstream of the first high pressure desuperheater 44). For example, if the steam requires cooling, the first high pressure desuperheater 44 can be completely bypassed using the control valves with heat being removed from the steam by the first high pressure steam/thermal media heat exchanger 176 and the steam being returned downstream of the first high pressure desuperheater 44 (and upstream of the second high pressure superheater 36). If additional cooling is required, a portion of the steam can be routed through the first high pressure desuperheater 44 and selectively cooled using the cooling water (e.g., the first high pressure steam/thermal media heat exchanger 176 and the first high pressure desuperheater 44 operate in tandem to cool the steam exiting the first high pressure superheater 32). In this example, if no steam cooling is needed, the steam can be routed entirely through the first desuperheater 44 but with no cooling water being fed to the first desuperheater 44 such that no cooling occurs. In this manner, steam can be cooled or not cooled to a desired temperature (e.g., within design parameters) using one or more of the high pressure desuperheater 44 and the first high pressure steam/thermal media heat exchanger 176 alone or in combination. Steam exiting the first high pressure steam/thermal media heat exchanger 176 and/or the first high pressure desuperheater 44 is fed to the second high pressure superheater 36. The thermal storage media heated by and exiting the first high pressure steam/thermal media heat exchanger 176 is fed, directly or indirectly, to a hot tank 194 (e.g., for storage or use).

Thermal storage media entering the first high pressure steam/thermal media heat exchanger 176 is fed from the cold tank 174, directly or indirectly, with the entrance of the first high pressure steam/thermal media heat exchanger 176 being in fluid communication with the cold tank 174 (e.g., fluid communication is provided by pipes or tubes 182 comprising a feed line). The cold tank 174, the first high pressure steam/thermal media heat exchanger 176, and the hot tank 194 form a superheater cooling loop which selectively extracts heat from steam heated by one or more high pressure superheaters of the HRSG 12. The thermal storage media moving from the cold tank to the first high pressure steam/thermal media heat exchanger 176, being heated, and then moving into the hot tank 194 (the thermal storage media selectively moving from the hot tank 194 to the cold tank 174 as heat is extracted for use in steam generation or other process as described later herein).

The thermal energy storage system 100 also includes a first reheat steam/thermal media heat exchanger 184 adapted and configured to remove heat from steam within the HRSG 12. The first reheat steam/thermal media heat exchanger 184 is a steam/thermal media heat exchanger of any suitable type as described previously in reference to the first high pressure steam/thermal media heat exchanger 176. Likewise, the first reheat steam/thermal media heat exchanger 184 operates and is controlled in reference to/in combination with the first reheater desuperheater 64 in the manner previously described with reference to the first high pressure steam/thermal media heat exchanger 176 and the high pressure desuperheater 44 (e.g., using one or more control valves and/or temperature sensors to operate in place of the desuperheater, in tandem with the desuperheater, or not at all with the steam being routed through a non-cooling desuperheater). The first reheat steam/thermal media heat exchanger 184 is in fluid communication with the cold tank 174, directly or indirectly, to receive thermal storage media (e.g., thermal media), from the cold tank 174. For example, the first reheat steam/thermal media heat exchanger 184 is connected by pipes, tubes, conduits 186 or the like (as with the other components described herein) to selectively bypass the first reheater desuperheater 64 connected between the first reheater 52 and the second reheater 58. Through control of the first reheat steam/thermal media heat exchanger 184 and the first reheater desuperheater 64, using the control valves and temperature sensors as previously described, steam can be cooled or not cooled to a desired temperature (e.g., within design parameters) using one or more of the first reheat steam/thermal media heat exchanger 184 and/or the reheater desuperheater 64. The first reheat steam/thermal media heat exchanger 184 is positioned such that it can be fed steam from the first reheater 52, the first reheat steam/thermal media heat exchanger 184 being in fluid communication, directly or indirectly, with the first reheater 52. Steam exiting the first reheat steam/thermal media heat exchanger 184 and/or the first reheater desuperheater 64 is fed to the second reheater 58. The thermal storage media heated by and exiting the first reheat steam/thermal media heat exchanger 184 is fed, directly or indirectly, to the hot tank 194 (e.g., for storage or use).

Thermal storage media entering the first reheat steam/thermal media heat exchanger 184 is fed from the cold tank 174, directly or indirectly, with the entrance of the first reheat steam/thermal media heat exchanger 184 being in fluid communication with the cold tank 174 (e.g., fluid communication is provided by pipes or tubes 185 comprising a feed line).

The cold tank 174, the first reheat steam/thermal media heat exchanger 184, and the hot tank 194 form a reheat cooling loop which selectively extracts heat from steam heated by one or more high reheaters of the HRSG 12. The thermal storage media moving from the cold tank 174 to the first reheat steam/thermal media heat exchanger 184, being heated, and then moving into the hot tank 194 (the thermal storage media selectively moving from the hot tank 194 to the cold tank 174 as heat is extracted for use in steam generation or other process as described later herein).

It should be understood that the cold tank 174 and/or the hot tank 194 can act as a buffer such that processes can run without requiring the transfer of thermal storage media from the hot tank 194 to the cold tank 174. In other words, the entirety of the thermal energy storage system 100 includes sufficient thermal storage media to provide a buffer. The heating of thermal storage media (and cooling of steam) using the superheater cooling loop and/or the reheat loop can operate independently of any process making use of heated thermal storage media from the hot tank 194 (to a degree). For example, the thermal energy storage system 100 includes sufficient buffer thermal storage media to allow the superheater cooling loop and/or the reheat loop to operate for expected periods of off peak/reduced load operation of any particular power plant.

A pump 192 supplies a flow of the heat storage media (e.g., thermal media) from the cold tank 174 to the first high pressure steam/thermal media heat exchanger 176. The pump 192 is any suitable pump for pumping the thermal media used by the thermal energy storage system 100 (e.g., a salt pump for molten salt thermal media). Flow provided by the pump 192 causes the heated thermal media exiting the first high pressure/thermal media heat exchanger 176 to transfer to the hot tank 194. A pump 198 likewise supplies a flow of the heat storage media (e.g., thermal media) from the cold tank 174 to the first reheat steam/thermal media heat exchanger 184. Flow provided by the pump 198 causes the heater thermal media exiting the first reheat steam/thermal media heat exchanger 184 to transfer to the hot tank 194.

The thermal energy storage system 100 also includes a water/thermal media heat exchanger 187 connected in fluid communication between the cold tank 174 and the hot tank 194. The water/thermal media heat exchanger 187 is a heat exchanger or multiple heat exchangers in parallel or series of any suitable type (e.g., as explained with reference to the high pressure evaporator 22) for transferring heat from a thermal media (e.g., molten salt) to water in order to, at least partially, create steam. The water/thermal media heat exchanger 187 is also connected in fluid communication with a source of water 189 (e.g., water provided by a feed pump or economizer). The source of water 189 provides water to the thermal energy storage system 100 for creating steam using thermal media from the hot tank 194 when the power plant has an increased demand for steam (e.g., when the power plant returns to base load operation from off peak operation). The water/thermal media heat exchanger 187 can also or alternatively be used to generate hot water, quality steam, saturated steam, superheated steam, supercritical steam, or used to heat up any other fluid in similar physical phases. The water/thermal media heat exchanger can be used in this manner with respect to any of the embodiments described herein.

During high steam/power demands of the combined cycle power plant, the heat storage media (e.g., thermal media or thermal storage media) is pumped by a pump 191 (e.g., any suitable pump including a salt pump for thermal salt thermal media) from the hot tank 194, through the water/thermal media heat exchanger 187 to the cold tank 174. A pump 193 can pump water from the water source 189 through the water/thermal media heat exchanger 187 or the water source 189 can be provided under pressure (e.g., from a pump, not shown). The heat storage media pumped through the water/ thermal media heat exchanger 187 produces saturated or superheated steam from the water pumped through the water/thermal media heat exchanger 187 by the water pump 193 (the water/thermal media heat exchanger 187, in any embodiment described herein, can also or alternatively be used to generate hot water, quality steam, saturated steam, superheated steam, supercritical steam, or used to heat up any other fluid in similar physical phases). The steam produced by the water/thermal media heat exchanger 187 travels through a separator 195 that separates residual water from the steam. The residual water is returned to the water/thermal media heat exchanger 187 by the pump 193. The steam produced is supplied as additional generated steam into the HRSG 12, for example downstream of the high pressure drum 24. Alternatively, or additionally, the steam produced is supplied to another process (e.g., district heating or power plant conditioning). This can be controlled using one or more control valves (not shown). Alternatively, heat exchanger 187 in this embodiment, or any other, may be configured to produce superheated steam which may then be fed into the steam system (e.g., within the HRSG or steam turbine) or elsewhere in the facility. The heat storage media leaving the water/thermal media heat exchanger 187 is delivered to the cold storage tank 174 which serves as a reservoir of cooled heat storage media for heating and cooling steam using the first high pressure steam/thermal media heat exchanger 176 and the first reheat steam/thermal media heat exchanger 184.

Control of the cold tank 174, hot tank 194, and the pump 191 can be effectuated based on the temperature of the storage media in the cold tank 174 and/or the hot tank 194 (e.g., based on corresponding temperature sensors). For example, flow of thermal media from the hot tank 194 to the cold tank 174 can ensure that the thermal media in the cold tank remains in a molten state.

The thermal energy storage system 100 thus allows power plants to operate more efficiently and with greater flexibility by storing energy generated at off design conditions, which is unusable or not needed, in a hot tank of heat storage media and returning the energy to the system in the form of additional steam, or to a separate user, at a time when energy is more useful (e.g., during base load operation). The thermal energy storage system can also produce steam for any suitable use using the water/thermal media heat exchanger 187. For example, the steam produced by the thermal energy storage system, for any of the embodiments described herein, can be delivered to an existing heat recovery steam generator system or any other potential steam user including but not limited to: the existing steam turbine, a new steam turbine/expander (e.g., added in a retrofit to an existing power plant that includes adding the thermal energy storage system), a drive system for mechanical equipment (e.g. pump), and/or any other process that makes use of steam.

Figure 3:
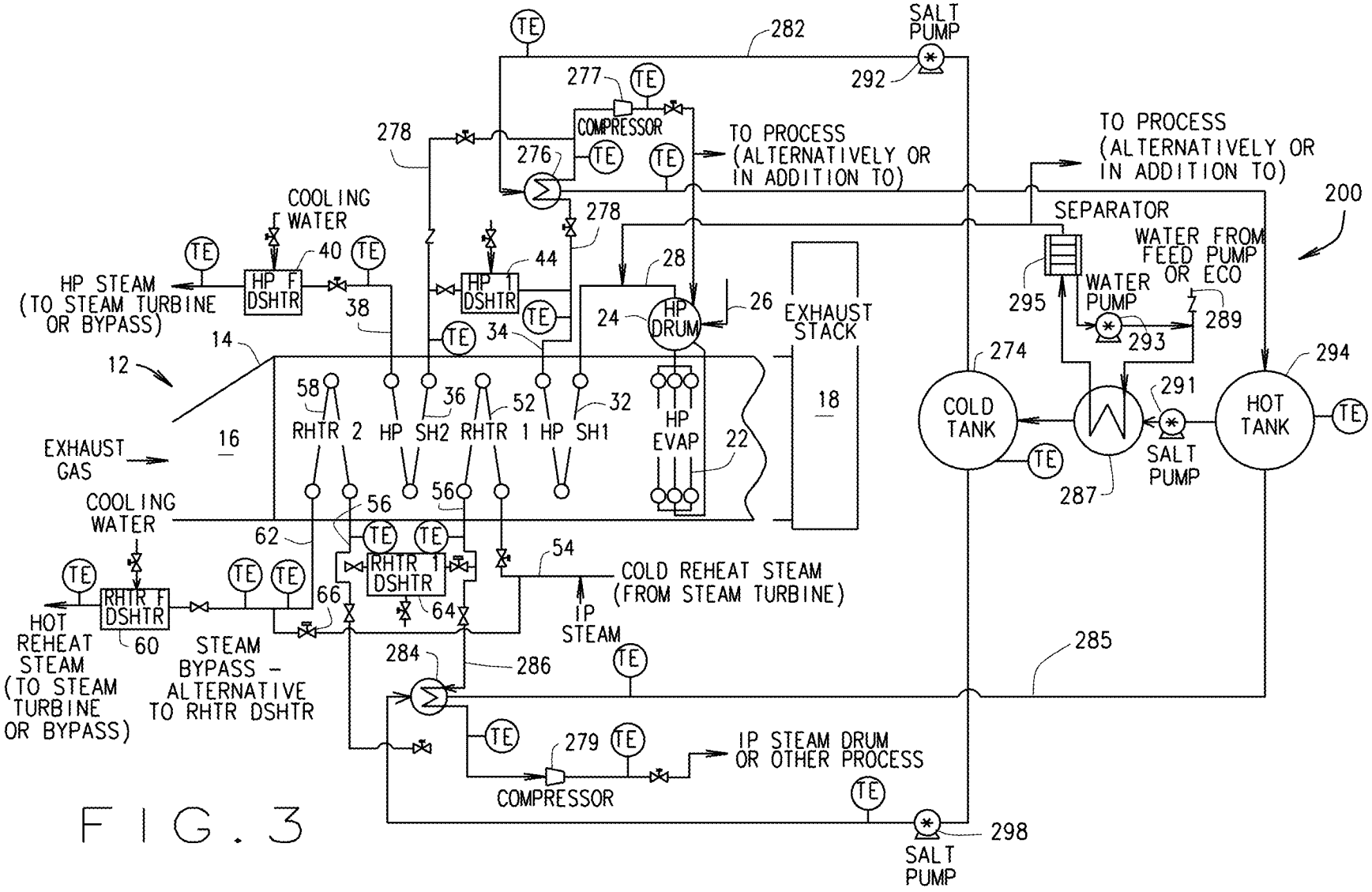
FIG. 3 is a diagrammatic representation of a thermal energy storage system of the type shown in FIG. 2 according to an alternative embodiment adapted and configured to, in part, also provide reheated steam to an intermediate pressure steam drum and/or other process and/or provide high pressure steam to process or return the same to a high pressure steam drum.

Referring now to FIG. 3, an alternative embodiment of thermal energy storage system 100 is depicted. The thermal energy storage system 200 depicted in FIG. 3 differs from the embodiment 100 described with reference to FIG. 2 in that the thermal energy storage system 200 includes two additional controllable steam outputs for use in other processes and/or supplying an intermediate steam drum. Specifically, the thermal energy storage system 200 includes a steam take off downstream of the first high pressure steam/thermal media heat exchanger 276 that selectively takes off steam, or a portion of steam, that otherwise would feed the second high pressure superheater 36 (e.g., control being provided by one or more control valves and one or more temperature sensors). Steam taken off is fed to a compressor 277. The compressor 277 is any suitable compressor for increasing the pressure of the steam. The compressor feeds selectively to one or more of an additional process (e.g., district heating or power plant conditioning) and/or the high pressure steam drum 24, the compressor being in fluid communication, directly or indirectly, with the other process equipment and the high pressure steam drum 24. Using the steam take off, the compressor 277, and/or the process take off, controlled by appropriate valves and temperature sensors, steam can be directed from the first high pressure steam/thermal media heat exchanger 276 to one or more, in any combination or amounts, the second high pressure superheater 36, the additional process, and/or the high pressure steam drum 24.

The thermal energy storage system 200 further includes a steam take off downstream of the first reheat steam/thermal media heat exchanger 284 that selectively takes off steam, or a portion of steam, that otherwise would feed the second reheater 58 (e.g., control being provided by one or more control valves and one or more temperature sensors). Steam taken off is fed to a compressor 279. The compressor 279 is any suitable compressor for increasing the pressure of the steam. The compressor feeds selectively to one or more of an additional process (e.g., district heating or power plant conditioning) and/or an intermediate pressure steam drum (not shown) for feeding the steam turbine of the power plant, the compressor being in fluid communication, directly or indirectly, with the other process equipment and the intermediate pressure steam drum. Using the steam take off, the compressor 279, and/or the process take off, controlled by appropriate valves and temperature sensors, steam can be directed from the first reheat steam/thermal media heat exchanger 284 to one or more, in any combination or amounts, the second reheater 58, the additional process, and/or the intermediate pressure steam drum.

Figure 4:
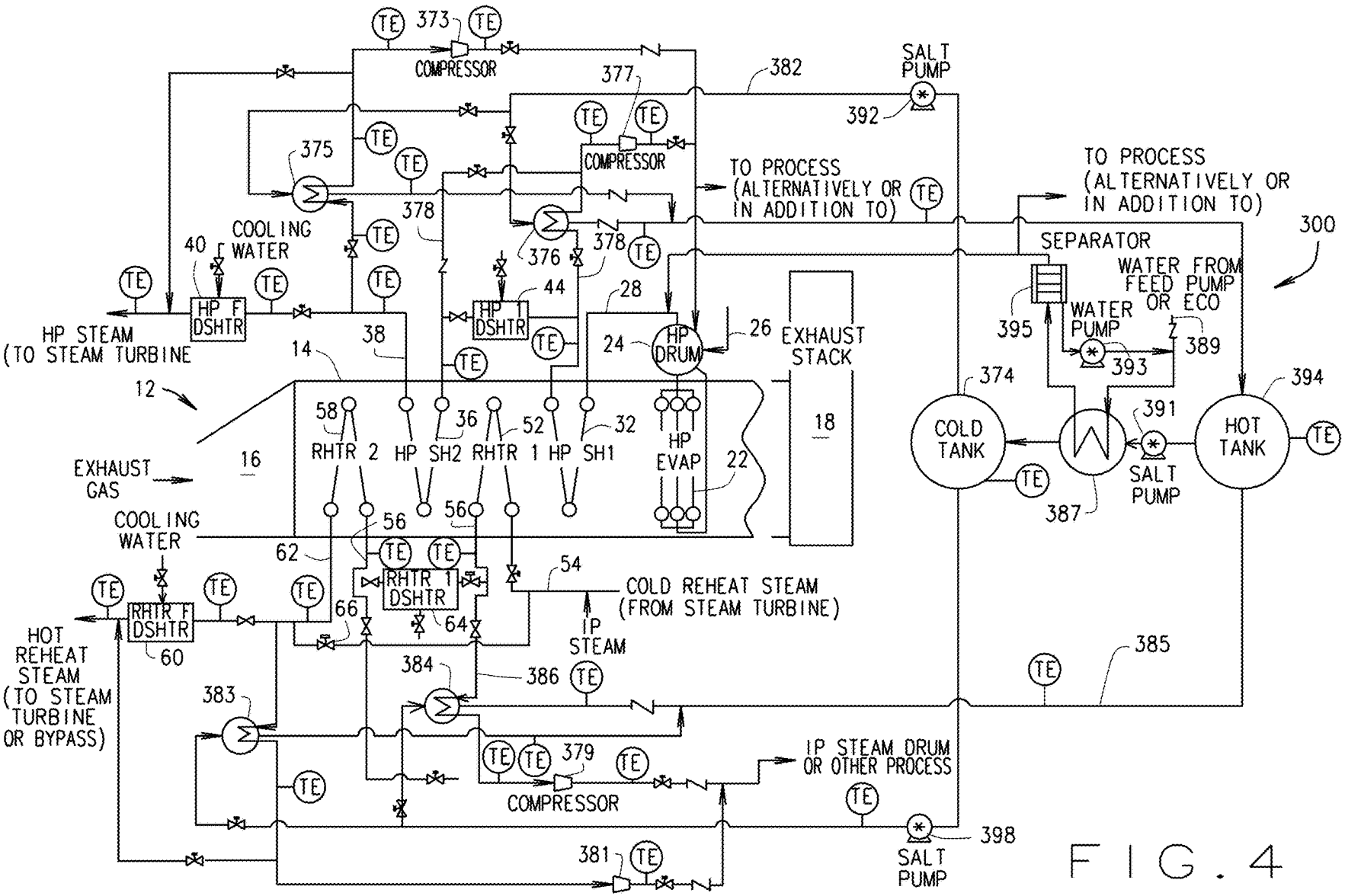
FIG. 4 is a diagrammatic representation of a thermal energy storage system of the type shown in FIGS. 2 and 3 according to an alternative embodiment adapted and configured to, in part, store thermal energy from a plurality of reheater and superheater heat exchangers of an HRSG and/or to provide the same to other processes or pressure specific steam drums within the HRSG.

Referring now to FIG. 4, an alternative embodiment of thermal energy storage system 200 is depicted. The thermal energy storage system 300 depicted in FIG. 4 differs from the embodiment 200 depicted in FIG. 3 in that the thermal energy storage system 300 includes two additional steam/thermal media heat exchangers and supporting compressors. Specifically, the thermal energy storage system 200 includes a second high pressure steam/thermal media heat exchanger 375 that is the same or similar to the first high pressure steam/thermal media heat exchanger 376. In parallel with respect to thermal media flow, the second high pressure steam/thermal media heat exchanger 375 is fed thermal media from the cold tank 374 and from a takeoff on the line feeding the first high pressure steam/thermal media heat exchanger 376, and heated thermal media exits the second high pressure steam/thermal media heat exchanger 375 and is fed into the hot tank 394 with the feed joining the output from the first high pressure steam/thermal media heat exchanger 376. The second high pressure steam/thermal media heat exchanger 375 is, selectively (e.g., through control valve and temperature sensor control), fed steam from a takeoff between the second high pressure superheater 36 and the second high pressure desuperheater 40. The second high pressure steam/thermal media heat exchanger 375, outputs steam downstream of the second high pressure desuperheater 40. This allows the second high pressure steam/thermal media heat exchanger 375 to work in the same manner as the first high pressure steam/thermal media heat exchanger 376 to control steam temperature for steam exiting the second high pressure superheater 36 as the first high pressure steam/thermal media heat exchanger 376 does for steam exiting the first high pressure superheater 32, while partially or completely avoiding the need for cooling from the second high pressure desuperheater 40. Steam exiting the second high pressure steam/thermal media heat exchanger 375 is fed to the high pressure steam portion of the steam turbine and/or selectively fed (all, none, or a portion) to a take-off and a compressor 373 in a similar manner as compressor 377 and the first high pressure steam/thermal media heat exchanger 376. Steam exiting the compressor 373 is fed to the high pressure drum 24. The thermal energy storage system 200 also includes a water/thermal media heat exchanger 287 connected in fluid communication between a cold tank 274 and a hot tank 294, which components operate and are connected similarly as described for corresponding components 187, 174 and 194 for system 100 of FIG. 2.

The thermal energy storage system 300 further includes a second reheat steam/thermal media heat exchanger 383 that is the same or similar to the first reheat steam/thermal media heat exchanger 384. The first reheat steam/thermal media heat exchanger 384 and the second reheat steam/thermal media heat exchanger 383 are fed thermal media from the cold tank 374 and from a takeoff on the line feeding the first reheat steam/thermal media heat exchanger 384 allowing the two exchangers (i.e., 383 and 384) to operate in parallel with respect to thermal media flow, and thermal media exits the second reheat steam/thermal media heat exchanger 383 and is fed into the hot tank 394 with the feed joining the output from the first reheat steam/thermal media heat exchanger 384. The second reheat steam/thermal media heat exchanger 383 is, selectively (e.g., through control valve and temperature sensor control), fed steam from a takeoff between the second reheater 58 and the second reheater desuperheater 60. The second reheat steam/thermal media heat exchanger 383 outputs steam downstream of the second reheater desuperheater 60. This allows the second reheat steam/thermal media heat exchanger 383 to work in the same manner as the first reheat steam/thermal media heat exchanger 384 to control steam temperature for steam exiting the second reheater 58 as the first heat exchanger 384 does for steam exiting the first reheater 52, while partially or completely avoiding the need for cooling from the second reheater desuperheater 60. Steam exiting the second reheat steam/thermal media heat exchanger 383 is fed as hot reheat steam to the turbine or to a bypass and/or selectively fed (all, none, or a portion) to a takeoff and a compressor 381 in a similar manner as compressor 379 and the first reheat steam/thermal media heat exchanger 384. Steam exiting the compressor 381 is fed to the intermediate pressure steam drum and/or to another process. The thermal energy storage system 300 also includes a water/thermal media heat exchanger 387 connected in fluid communication between a cold tank 374 and a hot tank 394, which components operate and are connected similarly as described for corresponding components 187, 174 and 194 for system 100 of FIG. 2.

Figure 5:
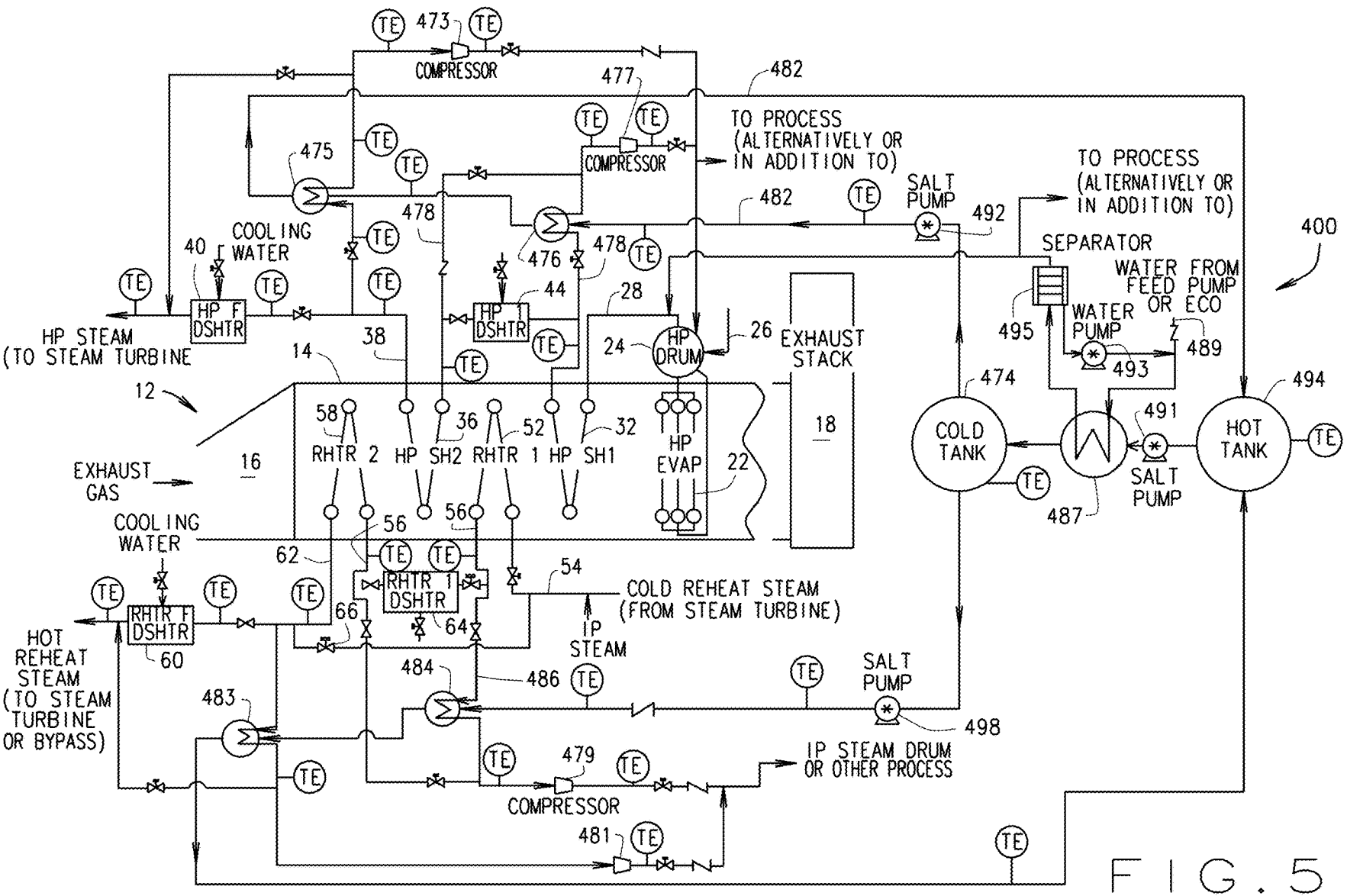
FIG. 5 is a diagrammatic representation of a thermal energy storage system of the type shown in FIG. 4 according to an alternative embodiment adapted and configured to, in part, store thermal energy extracted serially from a plurality of reheater heat exchangers and extracted serially from a plurality of superheater heat exchangers of an HRSG and/or to provide the same to other processes or pressure specific steam drums within the HRSG.

Referring now to FIG. 5, an alternative embodiment of thermal energy storage system 300 is depicted. The thermal energy storage system 400 depicted in FIG. 5 differs from the embodiment 300 depicted in FIG. 4 in that the thermal energy storage system 400 has thermal media serially feeding the high pressure steam/thermal media heat exchangers and serially feeding the reheat steam/thermal media heat exchangers. More specifically, the flow of steam remains the same for the first high pressure steam/thermal media heat exchanger 476, the second high pressure steam/thermal media heat exchanger 475, the first reheat steam/thermal media heat exchanger 484, and the second reheat steam/thermal media heat exchanger 483. The flow of thermal media differs from thermal energy storage system 300. Thermal media from cold tank 474 is pumped to the first high pressure steam/thermal media heat exchanger 476 where it is heated and exits from the first high pressure steam/thermal media heat exchanger 476 and is fed into the second high pressure steam/thermal media heat exchanger 475 (e.g., directly or indirectly). Heated thermal media then returns to hot tank 494. Thermal media from cold tank 474 is also pumped to the first reheat steam/thermal media heat exchanger 484 where it is heated and exits from the first reheat steam/thermal media heat exchanger 484 and is fed into the second reheat steam/thermal media heat exchanger 483 (e.g., directly or indirectly). Heater thermal media then returns to hot tank 494. Thermal energy storage system 400 further includes a water/thermal media heat exchanger 487 connected in fluid communication between a cold tank 474 and a hot tank 494, which components operate and are connected similarly as described for corresponding components 187, 174 and 194 for system 100 of FIG. 2.

Figure 6:
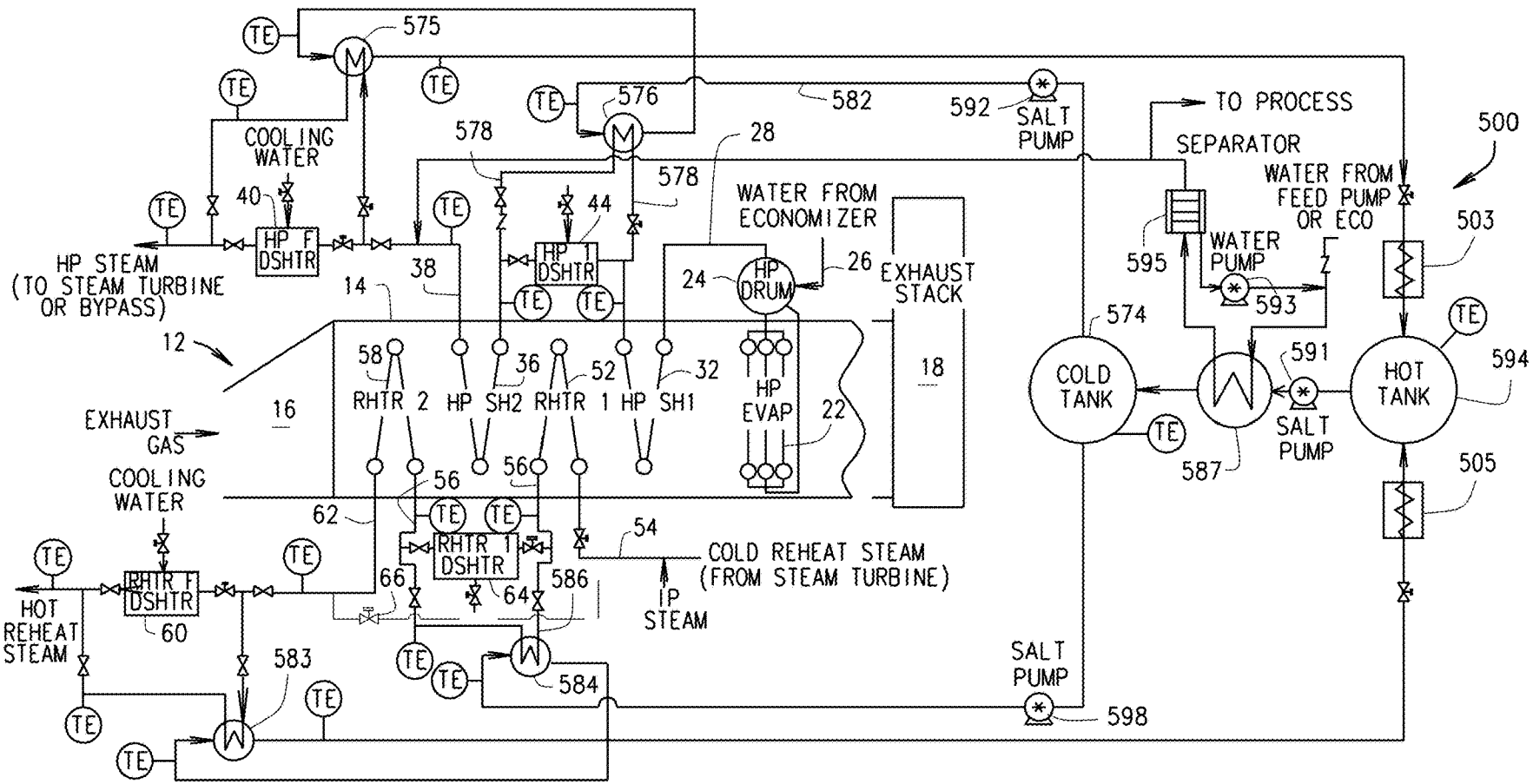
FIG. 6 is a diagrammatic representation of a thermal energy storage system of the type shown in FIG. 5 according to an alternative embodiment that includes one or more electric heaters adapted and configured to further control the temperature of a working fluid used to store thermal energy extracted from a plurality of reheat heat exchangers and superheater heat exchangers and/or to provide the same to other processes or pressure specific steam drums within the HRSG.

Referring now to FIG. 6, an alternative embodiment of thermal energy storage system 400 is depicted. The thermal energy storage system 500 depicted in FIG. 6 differs from the embodiment 400 depicted in FIG. 5 in that the thermal energy storage system 500 includes electric heaters for controlling the temperature of the thermal media and omits the compressors of thermal energy storage system 400. Specifically, the thermal energy storage system 500 omits the compressors 477, 473, 481, and 479 of thermal energy storage system 400. In thermal energy storage system 500, the steam exiting the first high pressure steam/thermal media heat exchanger 576 is fed to the second high pressure superheater 36, and the steam exiting the second high pressure steam/thermal media heat exchanger 575 is fed to the high pressure portion of the steam turbine (or a bypass). Likewise, the steam exiting the first reheat steam/thermal media heat exchanger 584 feeds the second reheater 58, and the steam exiting the second reheat steam/thermal media heat exchanger 583 is fed as hot reheat steam to the steam turbine (or a bypass). The thermal energy storage system 500 also differs from other embodiments in that the steam generated using the hot thermal media and the water/thermal media heat exchanger 587 is not provided to the high pressure steam drum 24 but is rather fed to the HRSG 12 upstream of the second high pressure desuperheater 40.

The thermal energy storage system 500 also includes a first electric heater 503 and a second electric heater 505. Each electric heater is any suitable electric heater for heating the thermal media (e.g., molten salt). The electric heaters 503, 505 are controlled (e.g., based on temperature sensors measuring the temperature of the thermal media in the hot tank 505 and/or the cold tank 574) to manage the temperature of the thermal media. For example, the electric heaters 503, 505 can maintain the temperature of the thermal media such that thermal media is pumpable. Alternatively, or additionally, the electric heaters 503, 505 allow for the thermal media temperature (e.g., salt temperature) to be further elevated in the event there is a desire to increase the steam temperature entering the downstream process (i.e., the process fed by steam generated using the water/thermal media heat exchanger 587). In the case that the downstream process is a steam turbine, the higher steam temperature helps to improve plant efficiency and at part load operation works to minimize condensation formation in the last stages of the steam turbine. Likewise, the electric heaters 503, 505 can be used to further elevate (in comparison to an embodiment without electric heaters) the temperature of the steam exiting the water/thermal media heat exchanger 587 that is fed to the HRSG 12 upstream of the second high pressure desuperheater 40 for use in providing high pressure steam to the steam turbine of the power plant. Electric heaters 503, 505 can be used in combination with any of the embodiments described herein. Likewise, the arrangement of the steam/thermal media heat exchangers (in parallel or in series) can be used in combination with any of the embodiments described herein. Thermal energy storage system 500 further includes a water/thermal media heat exchanger 587 connected in fluid communication between a cold tank 574 and a hot tank 594, which components operate and are connected similarly as described for corresponding components 187, 174 and 194 for system 100 of FIG. 2, but with heaters 503 and 505 operating as described.

Figure 7:
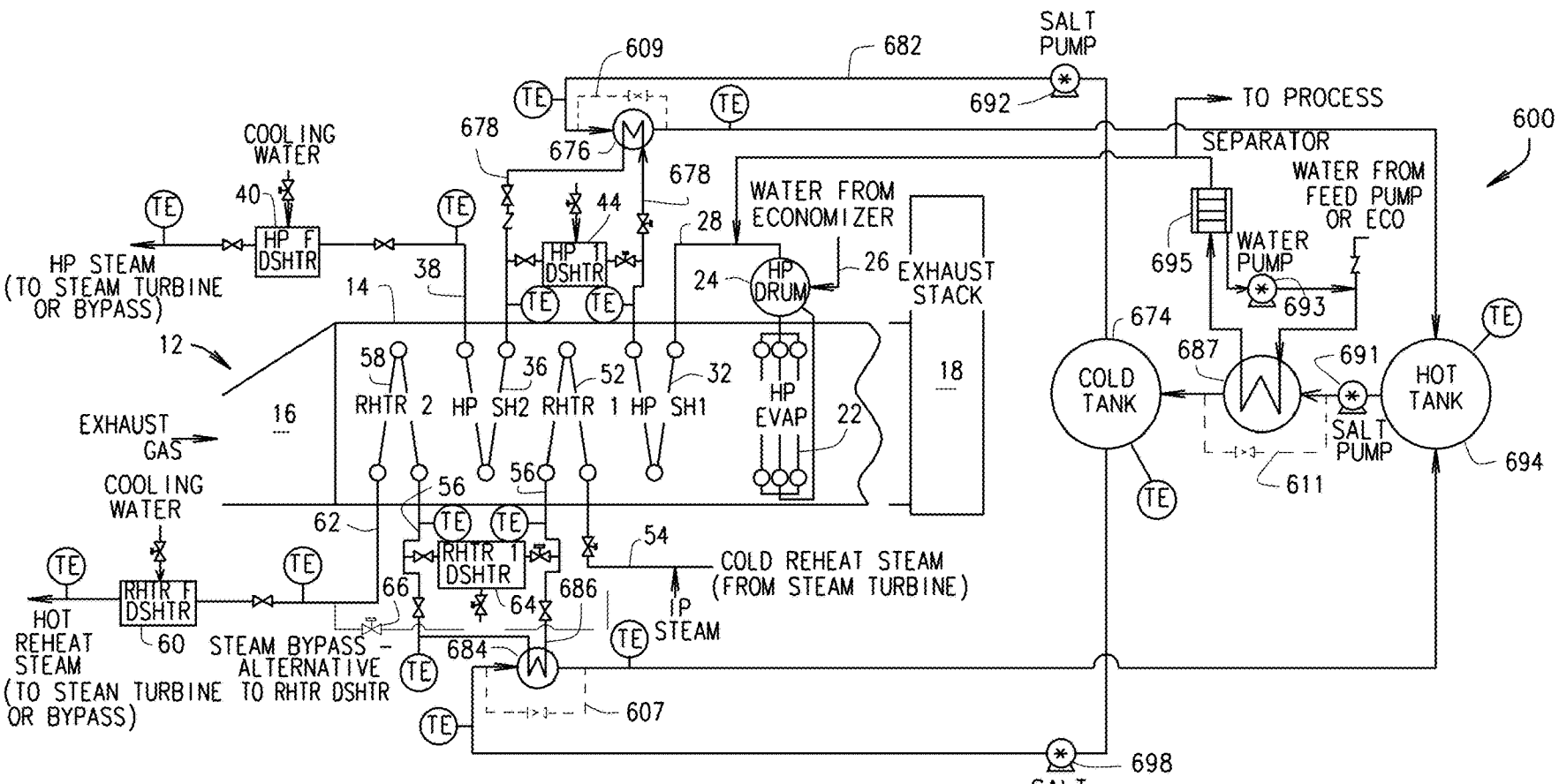
FIG. 7 is a diagrammatic representation of a thermal energy storage system of the type shown in FIG. 2 with bypass(es) for further controlling the thermal energy storage system and the supply of steam to the combined cycle power plant and/or other process(es).

Referring now to FIG. 7, an embodiment of the thermal energy storage system 600 is depicted which includes a variety of controllable bypasses (e.g., controlled based on steam/process needs, temperature sensors, pressure sensors, etc.). It should be understood that bypasses of the type shown and described with response to the thermal energy storages system 600 can be used in connection with any embodiment described herein. The thermal energy storage system 600, specifically, is similar to the thermal energy storage system 100 described with reference to FIG. 2 except that the thermal energy storage system 600 includes several bypasses. The thermal energy storage system 600 includes a bypass 607 that allows for the thermal media to selectively and controllably bypass the first reheat steam/thermal media heat exchanger 684. A similar bypass can be used in embodiments that include a second reheat steam/thermal media heat exchanger. The bypass 609 allows for the thermal media to selectively and controllably bypass the first high pressure steam/thermal media heat exchanger 676. A similar bypass can be used in embodiments that include a second high pressure steam/thermal media heat exchanger. The thermal energy storage system 600 also includes a bypass 611 that allows thermal media to transfer from the hot tank 694 to the cold tank 674 without heat being extracted by the water/thermal media heat exchanger 687. Any other such bypasses can be used with respect to any component of the embodiments described herein.

In the alternative embodiments of FIGS. 3-7, elements have been given numerals similar to those of the FIG. 2 embodiment in having the last two digits corresponding to those give for elements having the same or similar function. For example, as to the description of FIG. 2 of thermal storage media entering the first high pressure steam/thermal media heat exchanger 176 being fed from the cold tank 174, directly or indirectly, with the entrance of the first high pressure steam/thermal media heat exchanger 176 being in fluid communication with the cold tank 174 (e.g., fluid communication is provided by pipes or tubes 182 comprising a feed line), in FIGS. 3-7: numerals 276, 376, 476, 576 and 676 correspond to the high pressure steam/thermal media heat exchanger 176; and numerals 282, 382, 482, 582 and 682 correspond to the pipes or tubes 182 for thermal media flow.

Throughout this disclosure, control of various equipment and/or processes is described. It should be understood that such control is carried out using any suitable control technique known to one of skill in the art. Valves can be of the type controllable by control circuits, computer control, programmable logic controllers, or the like. For example, the valves can be solenoid, pneumatic, or other motor controlled valves. Control can be based on temperature sensors, pressure sensors, power output sensors, and/or any other suitable sensors and/or sensor data or algorithm using such data as known to one of skill in the art. Components connected with lines are in fluid communication with each other and can be connected directly or with intervening components in other embodiments not depicted. It should be understood that the preferred embodiment is as depicted and for direct fluid communication to avoid losses in both heat and pumping.

As various changes could be made in the above constructions methods without departing from the broad scope of the disclosure, it is intended that all matter contained in the above description or shown in the accompanying drawings shall be interpreted as illustrative and not in a limiting sense.

What is claimed is:

1. A heat recovery steam generator (HRSG) with thermal energy storage system comprising:

a housing having an inlet configured to receive exhaust gas from a fired turbine, the housing configured to have an outlet and an internal gas exhaust flow path between the inlet and outlet;

superheater coils of heat exchanger tubes, the superheater coils located within the housing internal exhaust flow path downstream from the inlet;

a high pressure evaporator comprising coils located within the housing internal exhaust flow path downstream from the housing inlet and superheater coils;

additional downstream coils of heat exchanger tubes, the said additional downstream coils located within the housing downstream of the high pressure evaporator coils, so that gas coming from the housing inlet can flow downstream through the superheater coils, through the high pressure evaporator coils and through the downstream coils towards the housing outlet;

a steam/media heat exchanger configured to receive steam from the heat recovery steam generator and to receive a flow of heat storage media, the steam/media heat exchanger being configured to transfer heat from the steam to the heat storage media and heat the heat storage media;

a storage hot tank in fluid communication with the steam/media heat exchanger, the storage hot tank being configured to receive the heated heat storage media from the steam/media heat exchanger and store the heated heat storage media;

a water/media heat exchanger configured to receive a flow of water and to receive the heated heat storage media stored in the hot tank from the hot tank, the water/media heat exchanger being configured to transfer heat from the heated heat storage media to the water to produce steam and deliver the steam to the heat recovery steam generator;

the heat recovery steam generator comprises a superheater and a desuperheater, and wherein the steam/media heat exchanger that receives steam from the heat recovery steam generator is adapted and configured to cool steam generated by the heat recovery steam generator in a manner that replaces or reduces operation of the desuperheater of the heat recovery steam generator.

2. The heat recovery steam generator (HRSG) with thermal energy storage system of claim 1, wherein the thermal energy storage system is adapted and configured to reduce the temperature of steam generated by the heat recovery steam generator and increase the temperature of the heat storage media when a power plant fed by the heat recovery steam generator is operating at reduced load or off design conditions, and wherein the thermal energy storage system is adapted and configured to utilize the stored heated heat storage media in the hot tank to generate steam using the water/media heat exchanger and supply the generated steam to the heat recovery steam generator when the power plant fed by the heat recovery steam generator is operating at peak load or at greater than peak load.

3. The heat recovery steam generator (HRSG) with thermal energy storage system of claim 1, wherein the heat recovery steam generator comprises at least a first reheater and a first reheater desuperheater, and the steam/media heat exchanger comprises a plurality of steam media heat exchangers including a first high pressure steam/media heat exchanger configured to replace or reduce operation of the first desuperheater, and a first reheat steam/media heat exchanger configured to replace or reduce operation of the first reheater desuperheater.

4. The heat recovery steam generator (HRSG) with thermal energy storage system of claim 3 wherein the heat recovery steam generator comprises a second desuperheater, a second reheat steam/media heat exchanger and a second reheater desuperheater, and the plurality of steam media heat exchangers includes a second steam/thermal media heat exchanger configured to replace or reduce the operation of the second desuperheater, and the second reheat steam/media heat exchanger configured to replace or reduce operation of the second reheater desuperheater.

5. The heat recovery steam generator (HRSG) with thermal energy storage system of claim 3 wherein the first high pressure steam/media heat exchanger is in fluid communication with the heat recovery steam generator downstream of a first super heater and downstream of the first desuperheater.

6. The heat recovery steam generator (HRSG) with thermal energy storage system of claim 3 wherein the first reheat steam/media heat exchanger is in fluid communication with the heat recovery steam generator downstream of a first reheater and downstream of a first reheater desuperheater.

7. The heat recovery steam generator (HRSG) with thermal energy storage system of claim 4 wherein the second steam/thermal media heat exchanger is in fluid communication with the heat recovery steam generator downstream of a second super heater and downstream of the second desuperheater.

8. The heat recovery steam generator (HRSG) with thermal energy storage system of claim 4 wherein the second reheat steam/media heat exchanger is in fluid communication with the heat recovery steam generator downstream of a second reheater and downstream of a second reheater desuperheater.

9. The heat recovery steam generator (HRSG) with thermal energy storage system of claim 4 further comprising a storage cold tank configured for storing thermal media received from the water/media heat exchanger being configured to transfer heat from the heated heat storage media to the water to produce steam and deliver the steam to the heat recovery steam generator, and wherein the cold tank is configured to supply thermal media to one or more steam/media heat exchangers.

10. The heat recovery steam generator (HRSG) with thermal energy storage system of claim 9 wherein the cold tank is configured to supply thermal media to the first high pressure steam/media heat exchanger and a second high pressure steam/media heat exchanger in parallel.

11. The heat recovery steam generator (HRSG) with thermal energy storage system of claim 9 wherein the cold tank is configured to supply thermal media to first and second reheat steam/thermal media heat exchangers in parallel.

12. The heat recovery steam generator (HRSG) with thermal energy storage system of claim 1, wherein a thermal media is molten salt.

13. The heat recovery steam generator (HRSG) with thermal energy storage system of claim 1, wherein the system is adapted and configured to be operated to transfer heat from the heated storage media to the water to produce steam and deliver the steam to the heat recovery steam generator to allow for a reduction in a gas turbine load while still producing steam at a rate sufficient for use by a steam turbine, wherein a gas turbine and a steam turbine are parts of a combined cycle power plant.

14. The heat recovery steam generator (HRSG) with thermal energy storage system of claim 1, wherein the system is adapted and configured to be operated to transfer heat from the heated storage media to the water to produce steam to allow for the production of additional steam during high ambient temperatures.

15. The heat recovery steam generator (HRSG) with thermal energy storage system of claim 1, wherein the water/media heat exchanger is configured to transfer heat from the heated storage media to the water to produce steam and deliver the steam to one or more of an existing heat recovery steam generator, an existing steam turbine of the existing heat recovery steam generator, an added steam turbine or added expander not part of an existing heat recovery steam generator, a steam driven pump, or a drive system for mechanical equipment.

16. A heat recovery steam generator (HRSG) with thermal energy storage system comprising:

a housing having an inlet configured to receive exhaust gas from a fired turbine, the housing configured to have an outlet and an internal gas exhaust flow path between the inlet and outlet;

superheater coils of heat exchanger tubes, the superheater coils located within the housing internal exhaust flow path downstream from the inlet;

a high pressure evaporator comprising coils located within the housing internal exhaust flow path downstream from the housing inlet and superheater coils;

additional downstream coils of heat exchanger tubes, the said additional downstream coils located within the housing downstream of the high pressure evaporator coils, so that gas coming from the housing inlet can flow downstream through the superheater coils, through the high pressure evaporator coils and through the downstream coils towards the housing outlet;

a steam/media heat exchanger configured to receive steam from the heat recovery steam generator and to receive a flow of heat storage media, the steam/media heat exchanger being configured to transfer heat from the steam to the heat storage media and heat the heat storage media;

a storage hot tank in fluid communication with the steam/media heat exchanger, the storage hot tank being configured to receive the heated heat storage media from the steam/media heat exchanger and store the heated heat storage media; and a superheater and a desuperheater, and wherein the steam/media heat exchanger that receives steam from the heat recovery steam generator is adapted and configured to cool steam generated by the heat recovery steam generator in a manner that replaces or reduces operation of the desuperheater of the heat recovery steam generator.

17. The heat recovery steam generator (HRSG) with thermal energy storage system of claim 16, wherein the thermal energy storage system is adapted and configured to reduce the temperature of steam generated by the heat recovery steam generator and increase the temperature of the heat storage media when a power plant fed by the heat recovery steam generator is operating at reduced load or off design conditions, and wherein the thermal energy storage system is adapted and configured to utilize the stored heated heat storage media in the hot tank to generate steam using the water/media heat exchanger and supply the generated steam to the heat recovery steam generator when the power plant fed by the heat recovery steam generator is operating at peak load or at greater than peak load.

18. The heat recovery steam generator (HRSG) with thermal energy storage system of claim 16, wherein the heat recovery steam generator comprises at least a first reheater and a first reheater desuperheater, and the steam/media heat exchanger comprises a plurality of steam media heat exchangers including a first high pressure steam/media heat exchanger configured to replace or reduce operation of the first desuperheater, and a first reheat steam/media heat exchanger configured to replace or reduce operation of the first reheater desuperheater.

19. The heat recovery steam generator (HRSG) with thermal energy storage system of claim 18, wherein the heat recovery steam generator comprises a second desuperheater, a second reheat steam/media heat exchanger and a second reheater desuperheater, and the plurality of steam media heat exchangers includes a second steam/thermal media heat exchanger configured to replace or reduce the operation of the second desuperheater, and the second reheat steam/media heat exchanger configured to replace or reduce operation of the second reheater desuperheater.

20. The heat recovery steam generator (HRSG) with thermal energy storage system of claim 18, wherein the first high pressure steam/media heat exchanger is in fluid communication with the heat recovery steam generator downstream of a first super heater and downstream of the first desuperheater.

21. The heat recovery steam generator (HRSG) with thermal energy storage system of claim 18, wherein the first reheat steam/media heat exchanger is in fluid communication with the heat recovery steam generator downstream of a first reheater and downstream of a first reheater desuperheater.

22. The heat recovery steam generator (HRSG) with thermal energy storage system of claim 19, wherein the second steam/thermal media heat exchanger is in fluid communication with the heat recovery steam generator downstream of a second super heater and downstream of the second desuperheater.

23. The heat recovery steam generator (HRSG) with thermal energy storage system of claim 19, wherein the second reheat steam/media heat exchanger is in fluid communication with the heat recovery steam generator downstream of a second reheater and downstream of a second reheater desuperheater.

24. The heat recovery steam generator (HRSG) with thermal energy storage system of claim 19, further comprising a storage cold tank configured for storing thermal media received from a water/media heat exchanger being configured to transfer heat from the heated heat storage media to the water to produce steam and deliver the steam to the heat recovery steam generator, and wherein the cold tank is configured to supply thermal media to one or more steam/media heat exchangers.

25. The heat recovery steam generator (HRSG) with thermal energy storage system of claim 24, wherein the cold tank is configured to supply thermal media to the first high pressure steam/media heat exchanger and a second high pressure steam/media heat exchanger in parallel.

26. The heat recovery steam generator (HRSG) with thermal energy storage system of claim 24, wherein the cold tank is configured to supply thermal media to first and second reheat steam/thermal media heat exchangers in parallel.

27. The heat recovery steam generator (HRSG) with thermal energy storage system of claim 16, wherein a thermal media is molten salt.

28. The heat recovery steam generator (HRSG) with thermal energy storage system of claim 16, wherein the system is adapted and configured to be operated to transfer heat from the heated storage media to the water to produce steam and deliver the steam to the heat recovery steam generator to allow for a reduction in a gas turbine load while still producing steam at a rate sufficient for use by a steam turbine, wherein a gas turbine and a steam turbine are parts of a combined cycle power plant.

29. The heat recovery steam generator (HRSG) with thermal energy storage system of claim 16, wherein the system is adapted and configured to be operated to transfer heat from the heated storage media to the water to produce steam to allow for the production of additional steam during high ambient temperatures.

30. The heat recovery steam generator (HRSG) with thermal energy storage system of claim 16, wherein a water/media heat exchanger is configured to transfer heat from the heated storage media to the water to produce steam and deliver the steam to one or more of an existing heat recovery steam generator, an existing steam turbine of the existing heat recovery steam generator, an added steam turbine or added expander not part of an existing heat recovery steam generator, a steam driven pump, or a drive system for mechanical equipment.

* * * * *